US009241583B2

(12) United States Patent
Nagel

(10) Patent No.: US 9,241,583 B2
(45) Date of Patent: Jan. 26, 2016

(54) PUSHER ASSEMBLY FOR PRODUCTS HAVING CIRCULAR PACKAGING

(71) Applicant: Thomas O. Nagel, Rockford, IL (US)

(72) Inventor: Thomas O. Nagel, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 14/210,708

(22) Filed: Mar. 14, 2014

(65) Prior Publication Data

US 2015/0257547 A1 Sep. 17, 2015

(51) Int. Cl.

| | |
|---|---|
| ***A47F 1/04*** | (2006.01) |
| ***A47F 1/12*** | (2006.01) |
| ***A47F 3/14*** | (2006.01) |

(52) U.S. Cl.

CPC ..... *A47F 1/126* (2013.01); *A47F 3/147* (2013.01)

(58) Field of Classification Search

CPC ..... A47F 3/147; A47F 1/126; A47F 1/125
USPC ..... 211/59.2–59.4; 312/190, 61, 71; 108/61
See application file for complete search history.

(56) References Cited

U.S. PATENT DOCUMENTS

| | | | | |
|---|---|---|---|---|
| 5,012,936 | A | 5/1991 | Crum | |
| 5,069,349 | A | 12/1991 | Wear et al. | |
| 5,133,463 | A | 7/1992 | Merl | |
| 5,205,524 | A | 4/1993 | Cohen | |
| 5,390,802 | A | 2/1995 | Pappagallo et al. | |
| 5,456,435 | A | 10/1995 | Sweeney | |
| 5,484,068 | A | 1/1996 | Huang | |
| 5,665,304 | A | 9/1997 | Heinen et al. | |
| 5,673,801 | A | 10/1997 | Markson | |
| 5,855,283 | A | 1/1999 | Johnson | |
| 6,082,558 | A | 7/2000 | Battaglia | |
| 6,142,317 | A | 11/2000 | Merl | |
| 6,179,136 | B1 | 1/2001 | Kluge et al. | |
| D453,273 | S * | 2/2002 | Goodman et al. | D6/462 |
| 6,364,136 | B1 | 4/2002 | Weshler et al. | |
| 6,719,152 | B1 | 4/2004 | Nagel et al. | |
| 6,745,906 | B1 | 6/2004 | Nagel | |
| 6,866,155 | B2 | 3/2005 | Nagel | |
| 6,866,156 | B2 | 3/2005 | Nagel et al. | |
| 6,886,700 | B2 | 5/2005 | Nagel | |
| 6,889,855 | B2 | 5/2005 | Nagel | |
| 6,923,330 | B1 * | 8/2005 | Nagel | 211/59.3 |
| 7,032,761 | B2 | 4/2006 | Nagel | |
| 7,419,062 | B2 | 9/2008 | Mason | |
| 7,458,473 | B1 | 12/2008 | Mason | |

(Continued)

OTHER PUBLICATIONS

U.S. Appl. No. 14/204,744, filed Mar. 11, 2014, Nagel.

*Primary Examiner* — Joshua J Michener
*Assistant Examiner* — Devin Barnett
(74) *Attorney, Agent, or Firm* — Reinhart Boerner Van Deuren P.C.

(57) ABSTRACT

A pusher tray is provided. The pusher tray includes a base structure defining a retail merchandise support surface. A pusher is slidably retained on the base structure and configured to bias retail merchandise toward a front stop of the pusher tray. The pusher has a floor and a front wall extending upwardly from the floor such that the front wall is oriented at an acute angle relative to the retail support surface. A pair of dividers are slidably mounted to the base structure. Each of the pair of dividers includes an arcuate frame portion and a pair of support elements supporting the arcuate frame portion such that a portion of each support element is tangent to a radius of curvature defined by each arcuate frame portion.

16 Claims, 9 Drawing Sheets

(56) References Cited

U.S. PATENT DOCUMENTS

| | | | |
|---|---|---|---|
| 7,681,744 | B2 | 3/2010 | Johnson |
| 7,690,519 | B2 | 4/2010 | Kahl et al. |
| 7,854,334 | B2 | 12/2010 | Nagel et al. |
| 7,931,156 | B2 | 4/2011 | Hardy |
| 8,210,367 | B2 | 7/2012 | Nagel et al. |
| 8,453,851 | B2 | 6/2013 | Ciesick |
| 8,720,702 | B2 | 5/2014 | Nagel |
| 2004/0168996 | A1 | 9/2004 | Jones |
| 2005/0127014 | A1 | 6/2005 | Richter et al. |
| 2006/0186065 | A1 | 8/2006 | Ciesick |
| 2006/0273053 | A1 | 12/2006 | Roslof et al. |
| 2007/0170127 | A1* | 7/2007 | Johnson ..... 211/59.3 |
| 2007/0175839 | A1 | 8/2007 | Schneider et al. |
| 2010/0025346 | A1 | 2/2010 | Crawbuck et al. |
| 2010/0107670 | A1 | 5/2010 | Kottke et al. |
| 2010/0108624 | A1 | 5/2010 | Sparkowski |
| 2010/0176075 | A1 | 7/2010 | Nagel et al. |
| 2010/0176077 | A1 | 7/2010 | Nagel et al. |
| 2011/0017684 | A1 | 1/2011 | Nagel et al. |
| 2011/0210086 | A1 | 9/2011 | Ciesick |
| 2012/0211450 | A1 | 8/2012 | Kologe |
| 2012/0255924 | A1 | 10/2012 | Kologe |
| 2013/0193095 | A1 | 8/2013 | Nagel |

* cited by examiner

PUSHER ASSEMBLY FOR PRODUCTS HAVING CIRCULAR PACKAGING

FIELD OF THE INVENTION

This invention generally relates to retail merchandise displays, and more particularly to pusher assemblies for biasing retail merchandise forward to front face the same.

BACKGROUND OF THE INVENTION

Pusher assemblies are well known in the art and provide for the automatic biasing or "front-facing" of retail merchandise towards a front edge of the assembly which is closest to the consumer. Such assemblies are readily recognized as reducing labor costs and providing an appealing look to the arrangement of retail merchandise in a retail merchandise display.

Unfortunately, certain types of retail merchandise are not readily usable in pusher assemblies due to their size and/or shape. One example of such an item of retail merchandise is the frozen pizza. As is well known, frozen pizza is typically packaged with an outer wrapper and a cardboard backing. This packaging generally has a circular outer periphery, which approximates the circular shape of the pizza carried therein. A typical pusher assembly often times incorporates upright divider walls on either side of the pusher assembly to contain the retail merchandise in a neat row. However, the Applicants have discovered that such upright divider walls make only minimal contact with objects having a circular outer periphery, and as a result, tend to not neatly contain such objects.

Furthermore, conventional pusher assemblies typically have a pusher with a front wall that is perpendicular to the retail merchandise support surface of the pusher assembly upon which the retail merchandise rests on. The Applicants herein have discovered that this perpendicular wall has a tendency to cause relatively larger and thinner items, e.g. frozen pizzas, to lean forward in a displeasing manner, and in some extreme cases, tip entirely forward. The Applicants have determined that this leaning or tipping is a caused primarily by the perpendicular orientation of the front wall of the pusher, which has a tendency to place a biasing force relatively high along the back surface of the retail merchandise creating a moment arm about the bottom edge of the retail merchandise, thereby causing it to rotate generally at this bottom edge to produce the aforementioned lean or tipping.

Accordingly, there is a need in the art for a pusher assembly that advantageously accommodates retail merchandise having a circular outer periphery, and biases the same with the aforementioned displeasing forward lean or tipping.

The invention provides such a pusher assembly. These and other advantages of the invention, as well as additional inventive features, will be apparent from the description of the invention provided herein.

BRIEF SUMMARY OF THE INVENTION

In one aspect, embodiments of the invention provide a pusher tray which advantageously accepts and front faces retail merchandise having a circular outer periphery in a neat and orderly fashion. A pusher tray according to this aspect includes a base structure that defines a retail merchandise support surface. A pusher is slideably retained on the base structure and is configured to bias retail merchandise toward a front stop of the pusher tray. A pair of dividers are slideably mounted to the base structure. Each of the pair of dividers includes an arcuate frame portion having a radius of curvature. The arcuate frame portion is configured to approximate a circular outer periphery of an item of retail merchandise carried by the pusher tray.

In another aspect, embodiments of the present invention provide a pusher tray that advantageously avoids the above described forward lean or tippage of retail merchandise caused by conventional pusher trays. Such a pusher tray includes a base structure defining a retail merchandise support surface. A pusher is slideably retained on the base structure and is configured to bias retail merchandise toward a front stop of the pusher tray. The pusher has a floor and a front wall extending upwardly from the floor such that the front wall is oriented at an acute angle relative to the retail support surface. A pair of dividers are slideably mounted to the base structure. Each of the pair of dividers includes a frame portion and pair of support elements supporting the frame portion.

In yet another aspect, embodiments of the present invention provide a pusher tray that accommodates a variety of retail merchandise independently of its overall shape. Such a pusher tray includes a base structure defining a retail merchandise support surface. A pusher is slideably retained on the base structure and is configured to bias retail merchandise toward a front stop of the pusher tray. The pusher has a floor and a front wall extending upwardly from the floor such that the front wall is oriented at an acute angle relative to the retail support surface. A pair of dividers are slideably mounted to the base structure. Each of the pair of dividers includes an arcuate frame portion and a pair of support elements supporting the arcuate frame portion such that a portion of each support element is tangent to a radius of curvature defined by each arcuate frame portion.

In certain embodiments, the base structure includes a pair of opposed support members and a wire frame supported by the support members. Each support member includes at front and rear ends thereof a relief notch. The wire support frame is mounted to the support members in the relief notches.

In certain embodiments each one of the pair of dividers includes a pair of support elements. The arcuate frame portion is supported by the pair of support elements such that the pair of support elements extend from the arcuate frame portion such that terminal ends of the support elements are received in the base structure. The arcuate frame portion has a first length. The pair of support elements are spaced apart a second length. The first length is greater than the second length. Each support element includes a straight portion and an angled portion. The angled portion is approximately tangent to a radius of curvature defined by the arcuate frame portion. In certain embodiments, the radius of curvature is between about three inches and about twelve inches.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
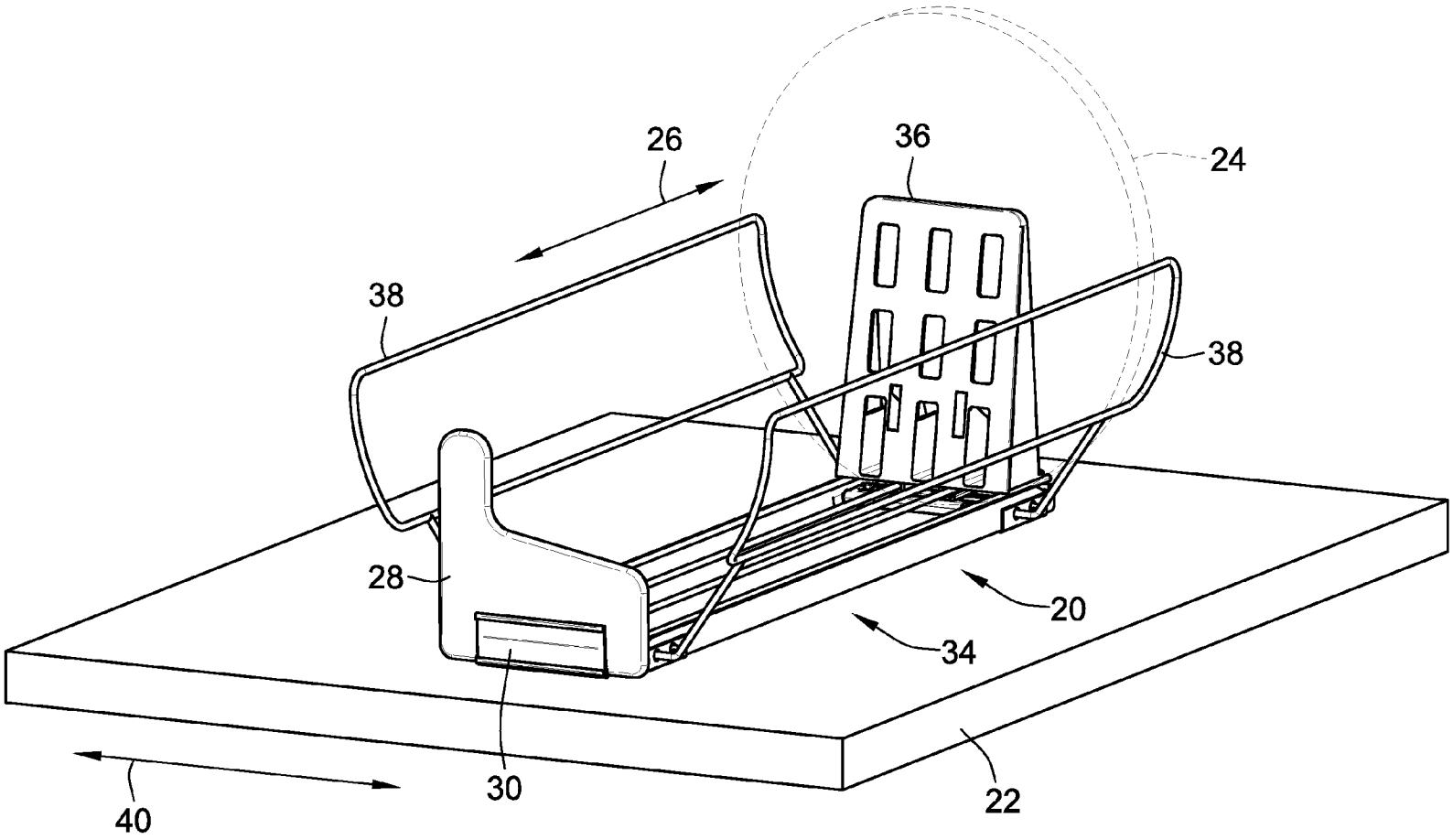
FIG. 1 is a perspective view of one embodiment of a pusher tray according to the teachings of the invention illustrated situated on a retail shelf with schematically represented items of retail merchandise carried therein.

Turning now to the drawings, the same illustrates an exemplary embodiment of a pusher tray 20 according to the teachings of the present invention. With particular reference to FIG. 1, pusher tray 20 is shown situated on a retail shelf 22. Those skilled in the art will readily recognize that there are various known mounting configurations for mounting pusher tray 20 in a fixed manner to retail shelf 22, and as such, for purposes of brevity, the particulars of such mounting configurations are not shown. Pusher tray 20 is shown carrying a plurality of items of retail merchandise 24 which as schematically shown in FIG. 1 are circular in shape.

An example of such an item of retail merchandise is frozen pizza. As is generally understood in the art relative to pusher assemblies, retail merchandise 24 is arranged in a linear row and is biased forward by pusher tray 20 in a direction which is parallel to axis 26 shown in FIG. 1 towards a front stop of pusher tray 20. As will be explained in greater detail below, pusher tray 20 overcomes the existing problems in the art by providing a new and improved divider arrangement which is specifically adapted to the circular outer periphery of retail merchandise 24, while also exerting a biasing force at an appropriate point on the rearmost item of retail merchandise 24 to prevent the above-referenced unacceptable forward lean or tipping of the retail merchandise 24 caused by conventional pusher systems.

Pusher tray 20 includes a base structure 34 which supports the previously referenced front stop 28 as well as a pusher 36, and a pair of moveable dividers 38 which are adjustable relative to base structure 34 in directions which are parallel to axis 40 shown in FIG. 1.

Figure 2:
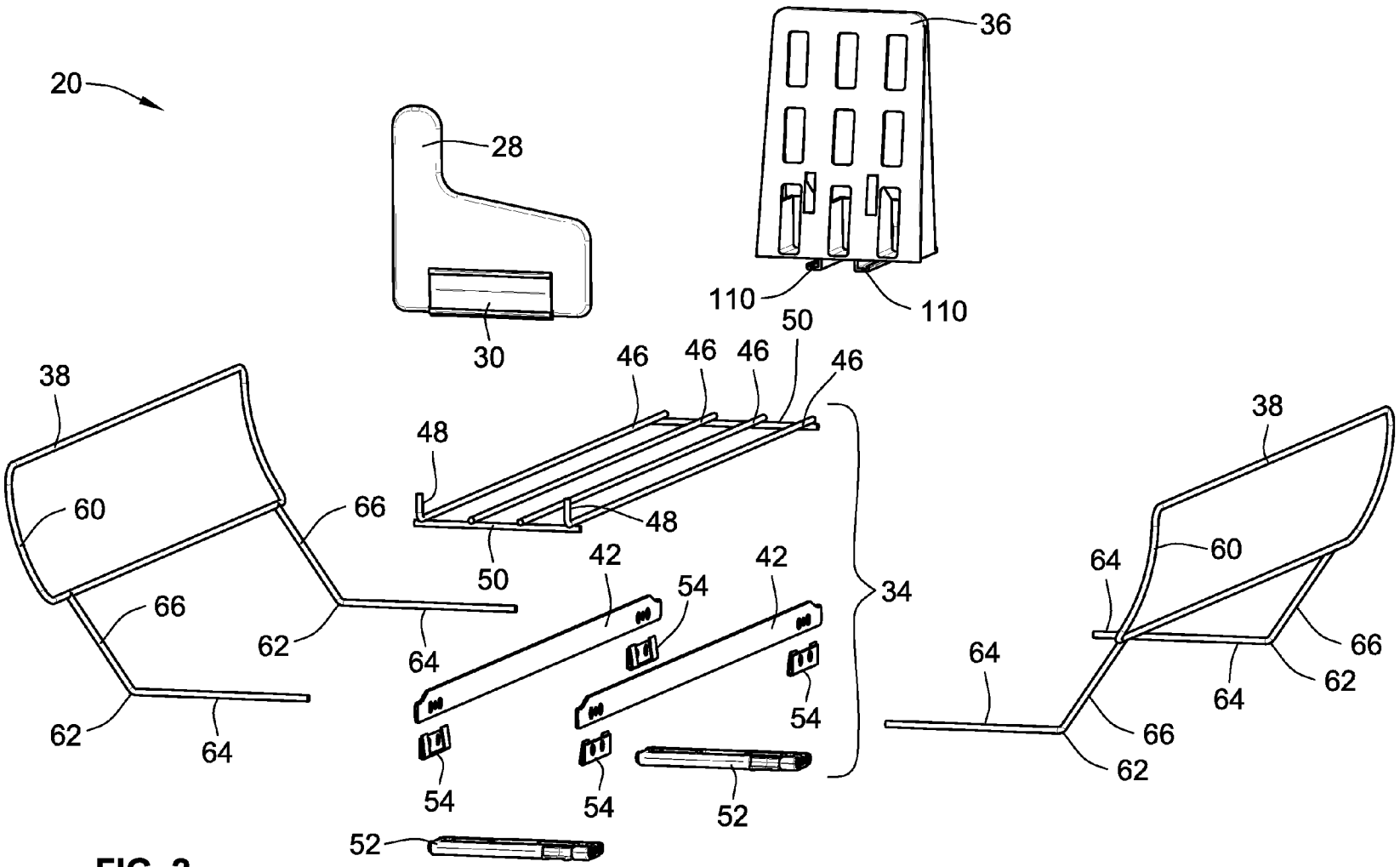
FIG. 2 is a perspective exploded view of the embodiment of FIG. 1.

Turning now to FIG. 2, pusher tray 20 is illustrated in an exploded view for purposes of elaborating upon the construction thereof. Base structure 34 includes a pair of opposed support members 42 which in the illustrated embodiment take the form of elongated bar like members. Support members 42 support a retail merchandise support floor in the form of a wire structure 44 as illustrated. Wire structure 44 includes a plurality of longitudinal members 46 arranged parallel to one another. The outermost ones of these longitudinal members 46 include upturned ends 48 for the connection and support of front stop 28 that optionally may also include a label holder 30 mounted thereto. Additionally, wire structure 44 also includes a pair of lateral support members 50 which are positioned below longitudinal members 46 and support the same. These elements may be welded together to form a generally rigid structure.

As can be seen from inspection of FIG. 2, each of longitudinal and lateral members 46, 50 of wire elements having a circular cross section. The upper surfaces of longitudinal members 46 lie in and define a plane also referred to herein as a retail merchandise support surface. This plane may be considered to be the plane within which the uppermost point of the circular cross section of each support member 46 lies with. The foregoing of course does not include the upturned ends 48 of the outermost longitudinal members 46.

Base structure 34 also includes a pair of support blocks 52 which mount within apertures formed in support members 42 as described below. Additionally, a plurality of mounting clips 54 are mounted at the interface of each support block 52 within support members 42. Mounting clips 54 also provide pad like surfaces on their undersides for purposes of mounting pusher tray 20 to retail shelf 22 as shown in FIG. 1.

Each divider 38 includes an arcuate frame section 60 supported by two frame elements 62 which are welded to arcuate frame portion 60. Each support element includes a straight portion 64 and an angled portion 66 which extends in an upwardly angled manner from straight portion 64 at an angle which is greater than ninety degrees but less than one hundred and eighty degrees. As can be seen from inspection of FIG. 2, straight portion 64 of each support element 62 is parallel to the previously described retail merchandise support plane or surface. Angled portions 66 extend relative to the aforementioned plane at a non-perpendicular angle.

Figure 3:
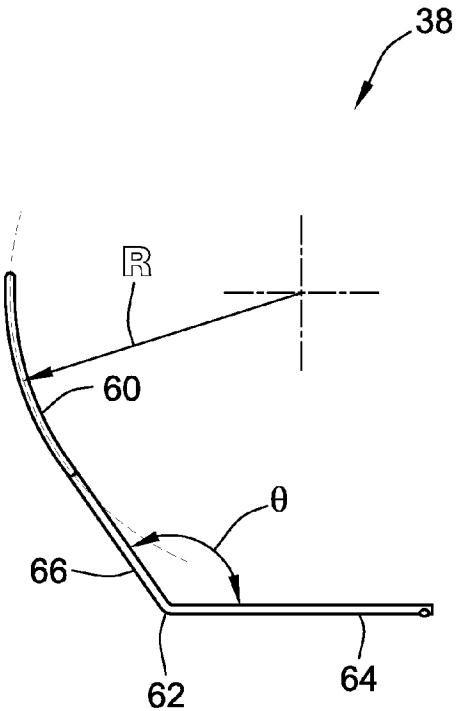
FIG. 3 is a front view of a divider of the embodiment of FIG. 1.

Turning now to FIG. 3, dividers 38 will be described in even greater detail. Dividers 38 are identical, and as such, the following description applies to both. As can be seen in FIG. 3, angled portions 66 form an angle Θ with straight portion 64 which as described above is greater than ninety degrees but less than one hundred and eighty degrees. As can also be seen in FIG. 3, angled portions 66 are approximately tangent to a radius of curvature R formed by arcuate frame portion 60. This radius of curvature R of arcuate frame portion 60 approximates the outer diameter of the retail merchandise intended to be carried by pusher tray 20. As such, in the illustrated embodiment radius of curvature R may be approximately six inches so as to accommodate a twelve inch diameter article of retail merchandise, e.g. a frozen pizza. Those of ordinary skill in the art will readily recognize, however, that radius of curvature R may be modified to approximate the radius of curvature of an outer periphery of the retail merchandise carried by pusher tray 20. As one non-limiting example, radius of curvature R may be between about three inches and about twelve inches. However, the specific dimensions of the radius of curvature R provided should be taken by way of example only.

Figure 4:
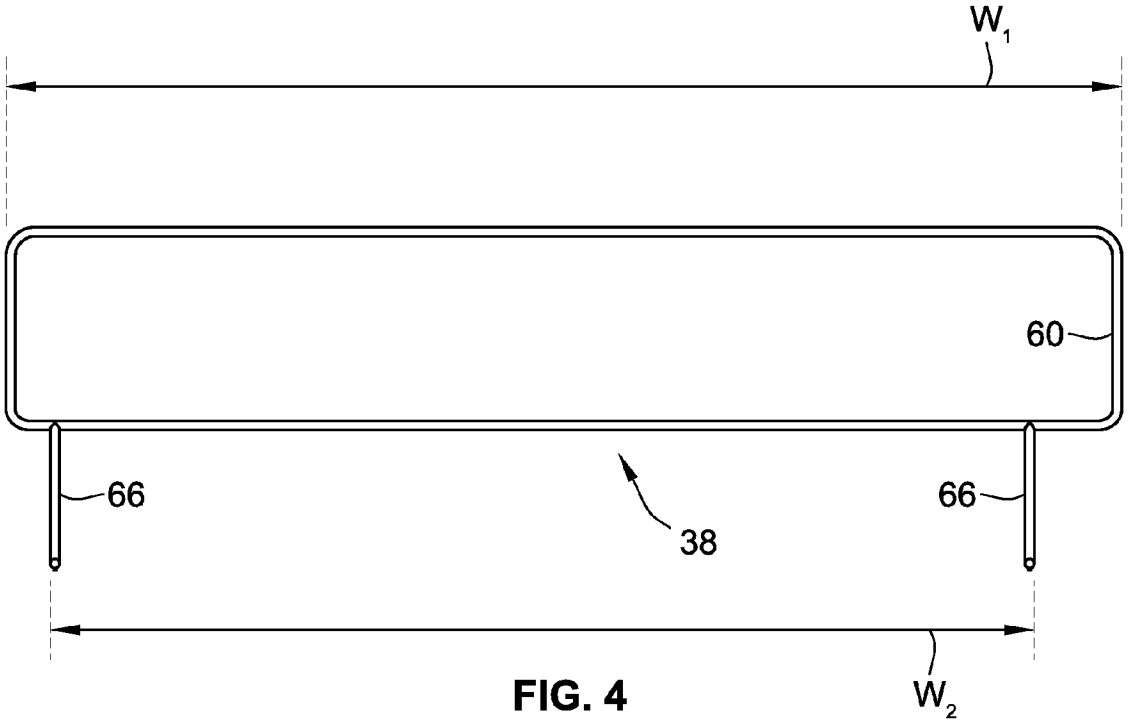
FIG. 4 is a side view of the divider of FIG. 3.

Turning now to FIG. 4, one of the two dividers 38 is shown in side view. As can be seen in this view, arcuate frame portion 60 has an overall length of $W_1$. The associated support elements 62 of this divider 38 are spaced apart at a distance of $W_2$. W1 is greater than $W_2$. This allows the mounting locations of each divider 38 relative to base structure 34 to be spaced inwardly from the opposed ends of base structure 34 but still allows for the containment of retail merchandise 24 along the full length of base structure 34.

Figure 5:
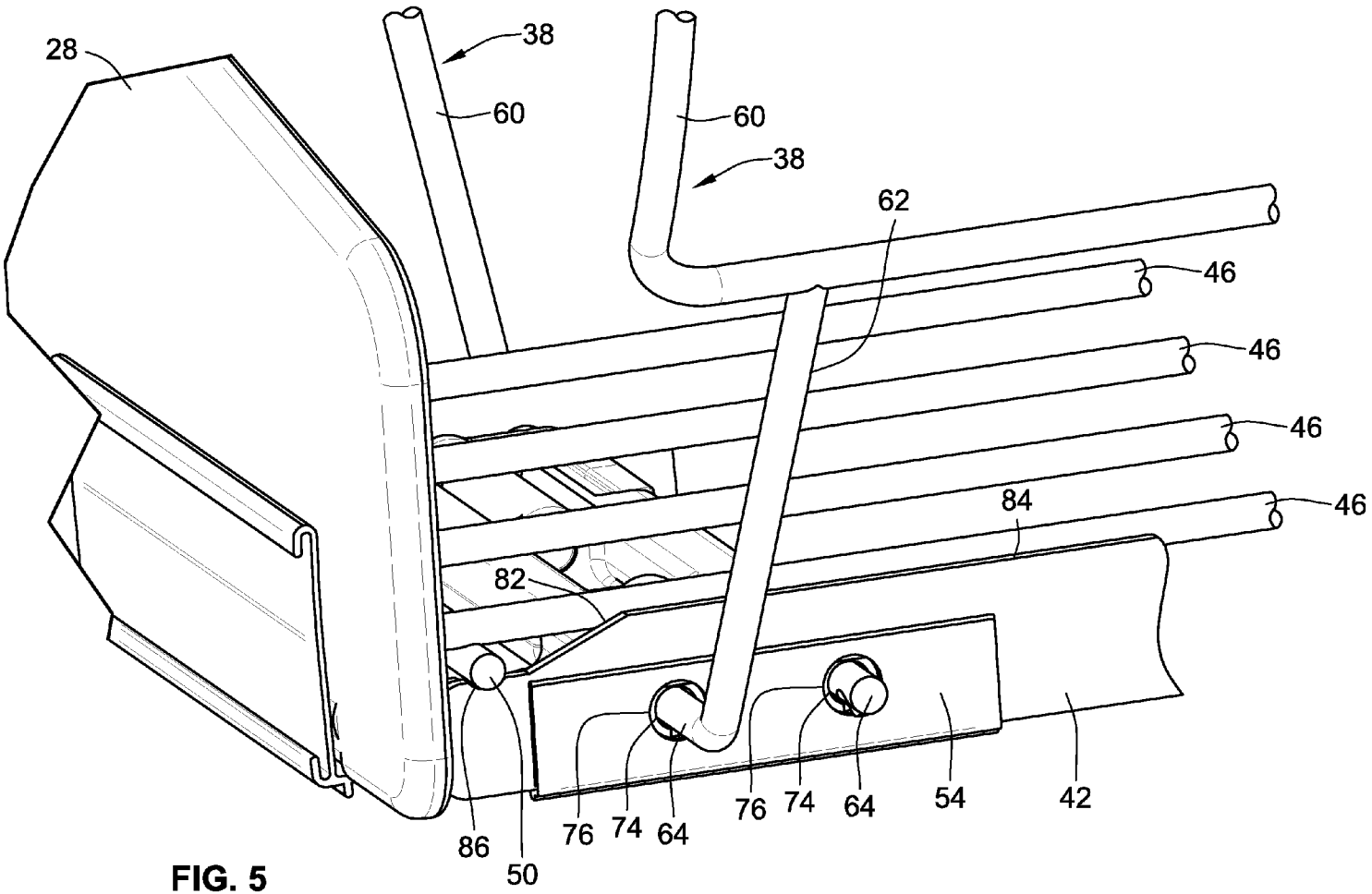
FIG. 5 is a partial perspective view of a front end area of the embodiment of FIG. 1.

Turning now to FIG. 5, the straight portion 64 of each support element 62 is received through apertures 74 formed in each support member 42. It will be recognized from inspection of FIG. 5 that the straight portion 64 of the forwardmost support element 62 of the rightmost divider 38 (see FIG. 1) overlaps the straight portion 64 of the forwardmost support element 62 of the leftmost divider 38 (See FIG. 1). It will also be recognized that the above-described construction of apertures 74, 76 relative to the rightmost support member 42 shown in FIG. 5 is identical to the aperture configuration for receiving straight portions 64 in the leftmost support member 42 (See FIG. 1) proximal the front end of pusher tray 20. Straight portions 64 are entirely removable from base structure 34 such that other dividers may be utilized having a different shape. For example, in the case of rectangular retail merchandise, e.g. boxed frozen pizza, upright dividers may be utilized.

As can also be seen in FIG. 5, each support member 42 includes a relief notch 82 which is recessed from an upper edge 84 of the support member 42 shown in FIG. 5. This relief notch 82 is formed proximal the front end of support member 42. Relief notch 82 also includes a seat 86 for receiving the circular outer periphery of the frontmost lateral member 50 of wire structure 44. As can be seen from inspection of FIG. 5, the foregoing construction of relief notch 82 allows for the retail merchandise support plane or surface described above to be in close proximity to upper edge 84 of support member 42.

In the case of heavier merchandise, some flexure of longitudinal members 46 may occur. However, as this flexure continues, eventually the retail merchandise will contact the upper edge 84 of the support member 42 so as to limit further flexure of longitudinal members 46. The foregoing description of relief notch 82 and its associated functionality for support member 42 shown in FIG. 5 is identical to the other support member 42. Furthermore, an identical configuration of apertures for receiving straight portions 64 of support elements 62 and relief notches exist on the base structure 34 proximal the rear end of base structure 34 as can readily been seen from inspection of FIG. 2. Accordingly, additional description of these identical elements has been dispensed with for purposes of brevity.

Figure 6:
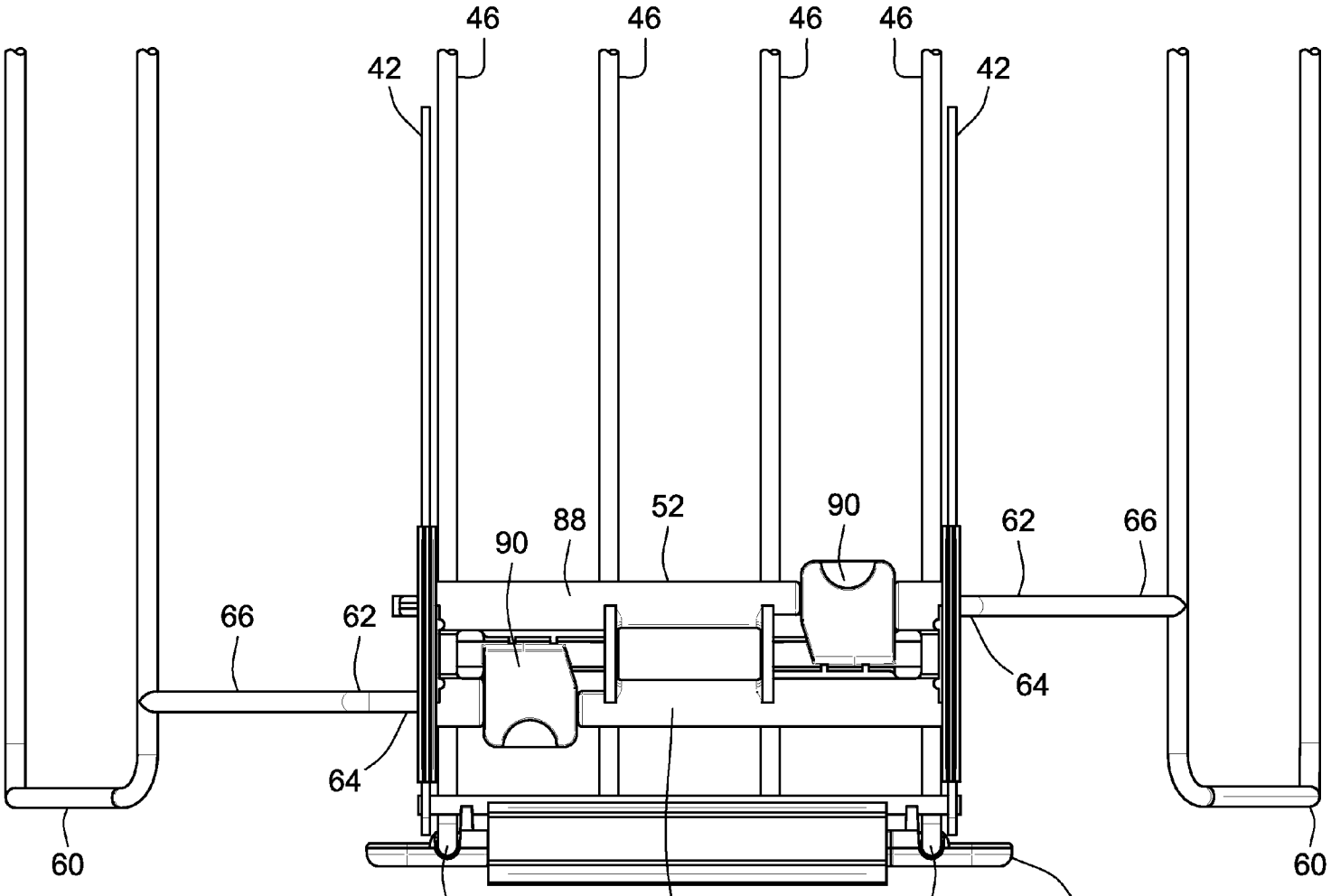
FIG. 6 is a partial bottom view of the embodiment of FIG. 1.

Turning now to FIG. 6, support blocks 52 will be described in greater detail. The frontmost support block 52 of pusher tray 20 is illustrated in FIG. 6. The following description applies equally well to the rearmost support block 52 (See FIG. 2). For purposes of brevity, a redundant description of the rearmost support block 52 is omitted. Each support block 52 includes a pair of parallel passageways 88. These passageways 88 receive straight portions 64 of support elements 62. Additionally, each support block 52 includes a pair of rotatable clips 90. As will be described in greater detail below, a portion of each clip 90 extends through an aperture formed in each passageway 88 to apply a frictional force against straight portion 64 to block straight portion 64 within passageway 88. Indeed, in normal operation straight portions 64 are slideable within passageways 88 to vary the overall width or spacing of the opposed dividers 38 (See FIG. 1). This allows for the accommodation of retail merchandise of differing widths.

Figure 7:
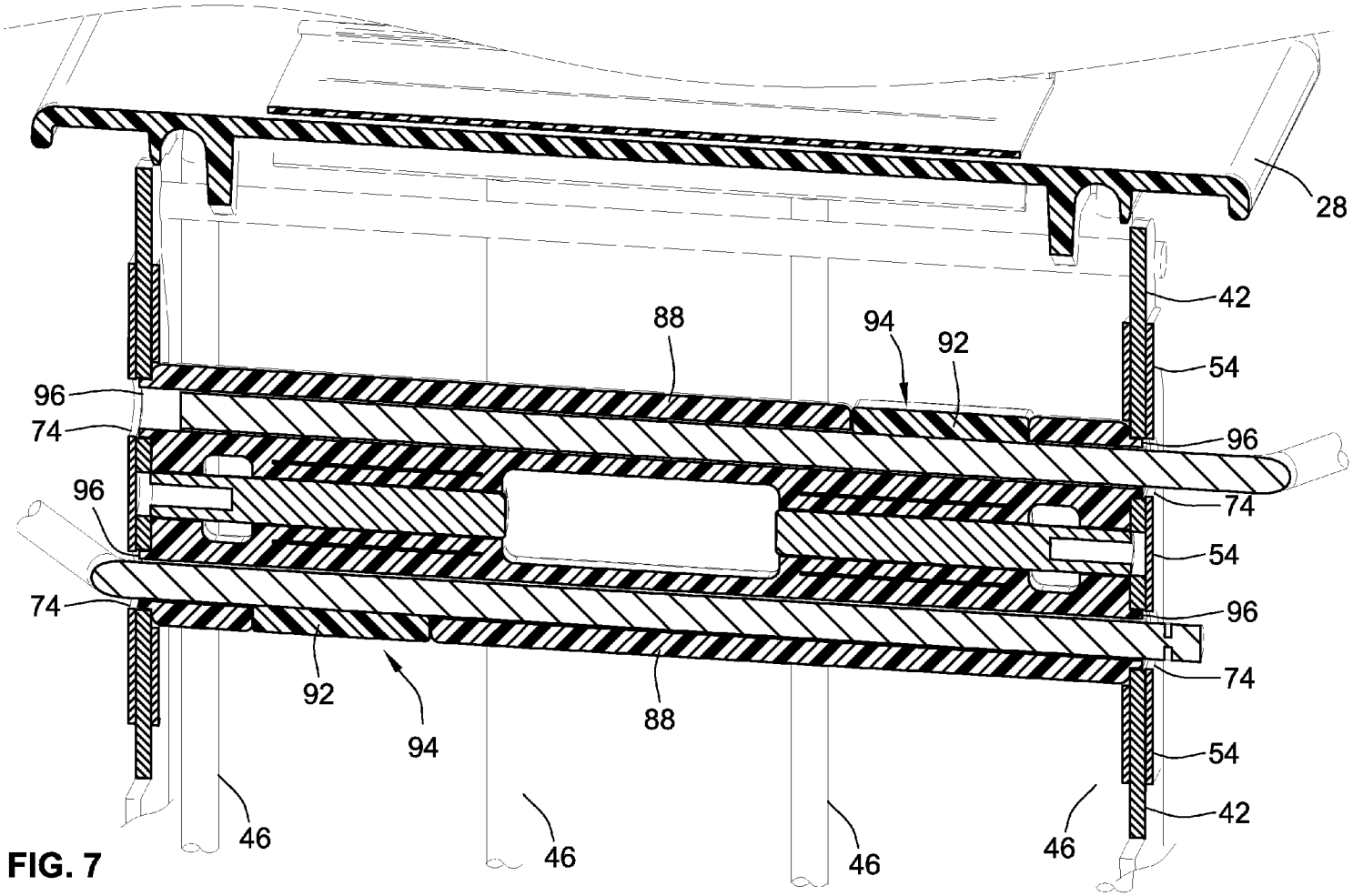
FIG. 7 is a partial view of a cross section taken through the embodiment of FIG. 1.

Once a particular width has been selected, however, it is undesirable for any unintended movement of dividers 38 to occur. As a result, clips 90 lock dividers 38 in place. The foregoing construction can also be seen from inspection of FIG. 7. FIG. 7 illustrates a cross section taken through support block 52 to expose the interior of passageways 88 and the corresponding receipt of straight portion 64 therein. As can also be seen in this view, a contact portion 92 extends into a corresponding aperture 94, forms in each passageway 88. As can also be seen in this view, flanges 96 extend from the opposed sides of support block 52. The flanges 96 extend into the above-described apertures 74 formed in each side member 42. This configuration permits for the snapped mounting of each support block 52 to support members 42.

Figure 8:
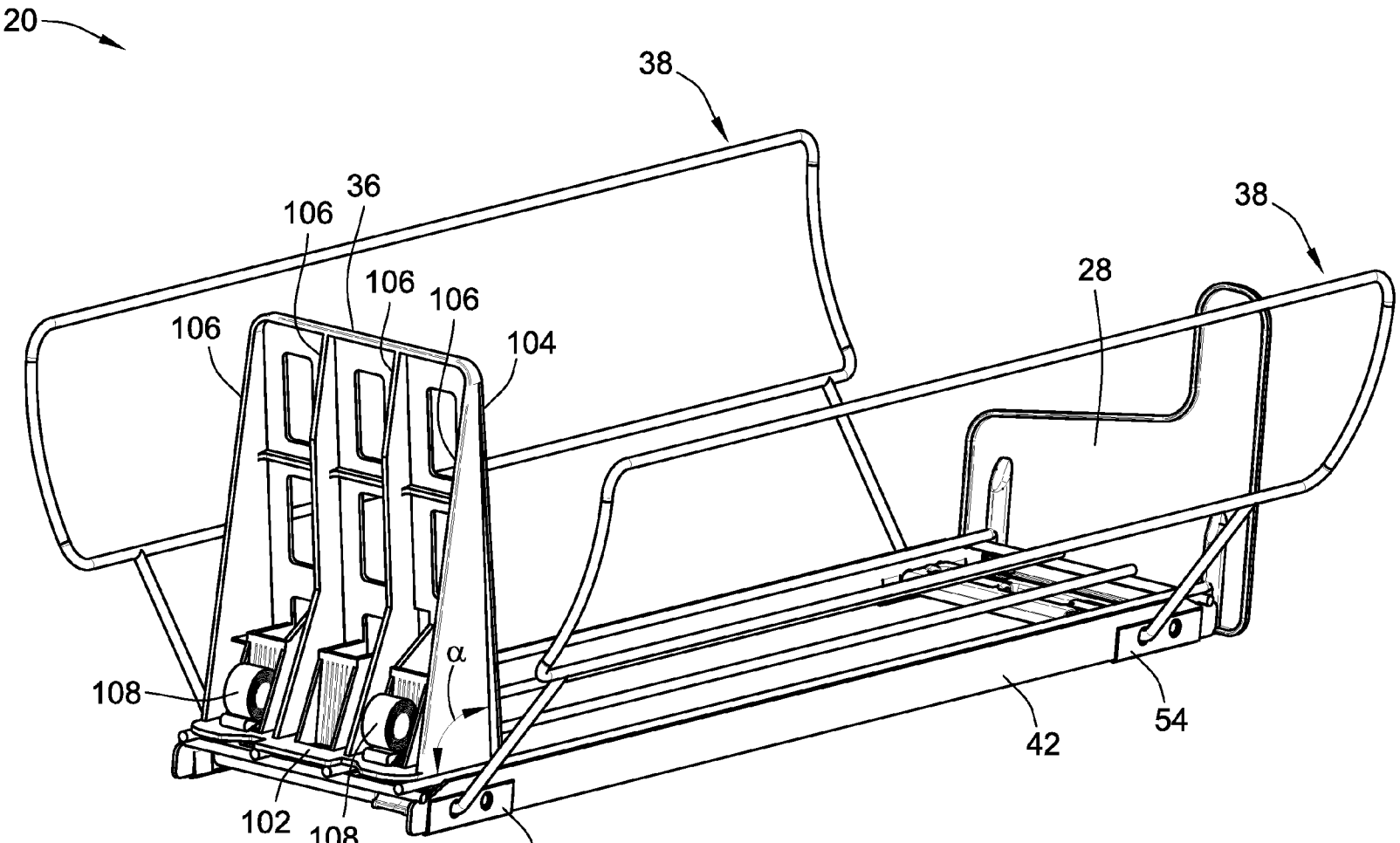
FIG. 8 is another perspective view of the embodiment of FIG. 1.

Turning now to FIG. 8, pusher 36 will be described in greater detail. Pusher 36 includes a base, 102. Base 102 is parallel to the above-described retail merchandise plane or support surface. Pusher 36 also includes a front wall 104 which extends from floor 102 at an angle $\alpha$ of less than ninety degrees. As will be described in greater detail below, the non-perpendicular construction of the front wall 104 allows for the area of the front wall 104 proximal the bottom thereof adjacent floor 102 to make first contact with retail merchandise. In the context of circular retail merchandise, e.g. frozen pizzas, the applicants have discovered that this configuration advantageously prevents the above-described forward lean or tipping caused by pusher structures which had a front wall generally perpendicular to the retail merchandise support surface. Indeed, unlike those configurations described above which contact the merchandise at a height which is relatively far away from the bottom of the retail merchandise, the tendency for the merchandise to lean forward or tip is significantly reduced or entirely prevented.

As can also be seen in FIG. 8, a plurality of support ribs 106 are formed on a back surface of front wall 104 and are joined with floor 102 to reinforce pusher 36. Additionally, one or more biasing elements, which in the exemplary embodiment are coil springs 108, are carried by pusher 36 and between adjacent ribs 106. As is generally known in the art, a terminal end of each coil spring 108 extends through an opening formed in pusher 36 and connects to a front end of pusher tray 20 to provide a biasing force to move pusher 36 toward front stop 28. Additionally, and with momentary reference back to FIG. 2, pusher 36 also includes wire receiving elements 110 extending from floor 102 which receive select ones of longitudinal members 46 of wire structure 34 to slideably retain pusher 36 on wire structure 44.

Figure 9:
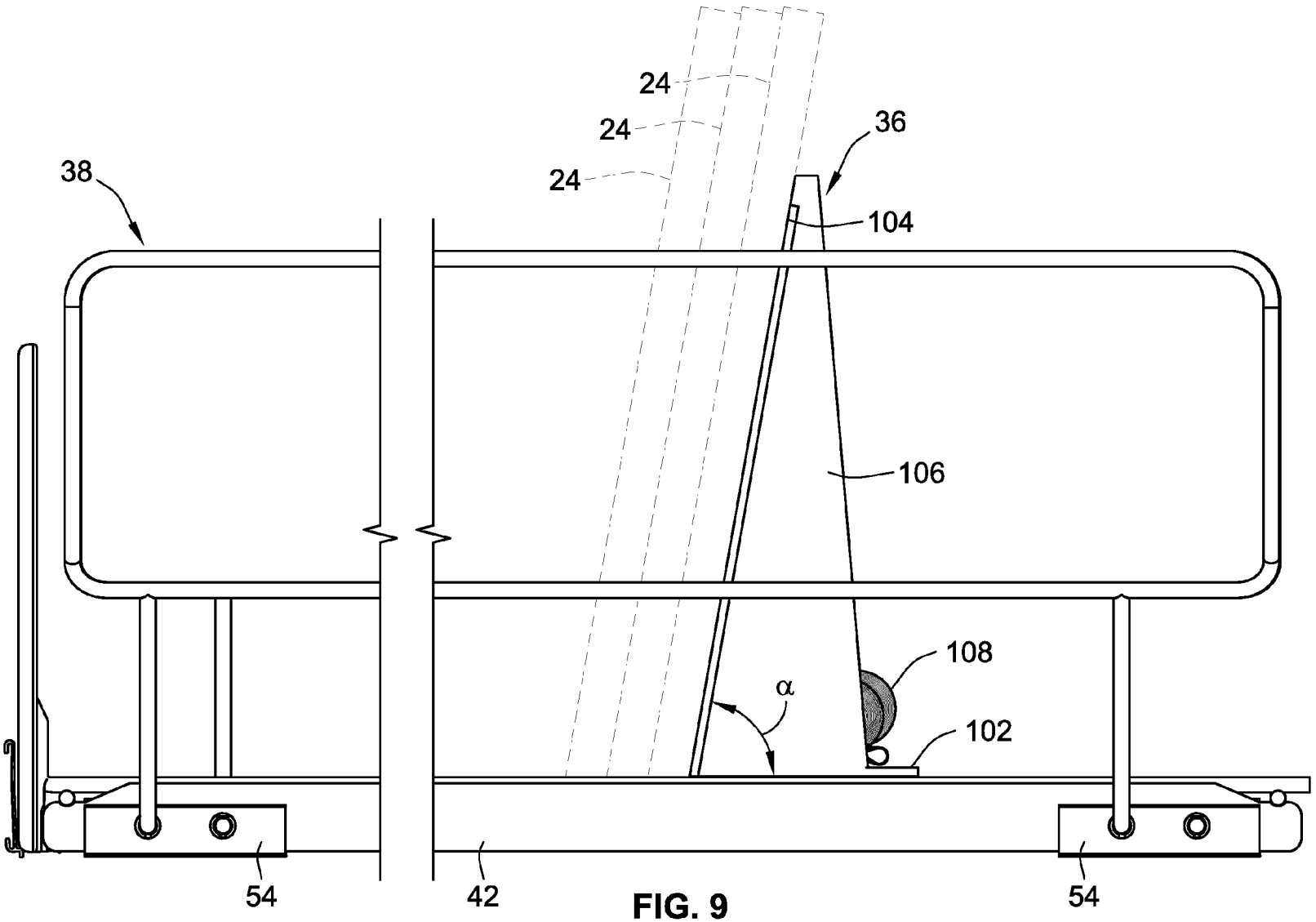
FIG. 9 is a side view of the embodiment of FIG. 1.

With reference now to FIG. 9, the foregoing advantages of the angled front wall 104 of pusher 36 are illustrated. As can be seen in this view, due to the acute angle $\alpha$ formed by front wall 104 with floor 102 of pusher 36, retail merchandise 24 is maintained generally vertical or perpendicular relative to the above-described retail support plane or surface. In the particular embodiment shown in FIG. 9, upper edges of retail merchandise 24 are generally in a cascaded or stepped configuration due to a slight rearward lean of merchandise 24. This configuration advantageously allows for the easy gripping of the front-most one of retail merchandise 24 as this upper-most edge is easily in view and differentiated from adjacent merchandise 24. Contrast the foregoing with a non-cascaded arrangement. In such a configuration, there is a tendency for consumers to accidently grab not only the front-most item of retail merchandise, but also subsequent items of retail merchandise located by the tray. In such circumstances, customers oftentimes place the additional items on the floor or in other areas other than the tray itself which results in spoilage, as well as the attendant cleanup and restocking.

Figure 10:
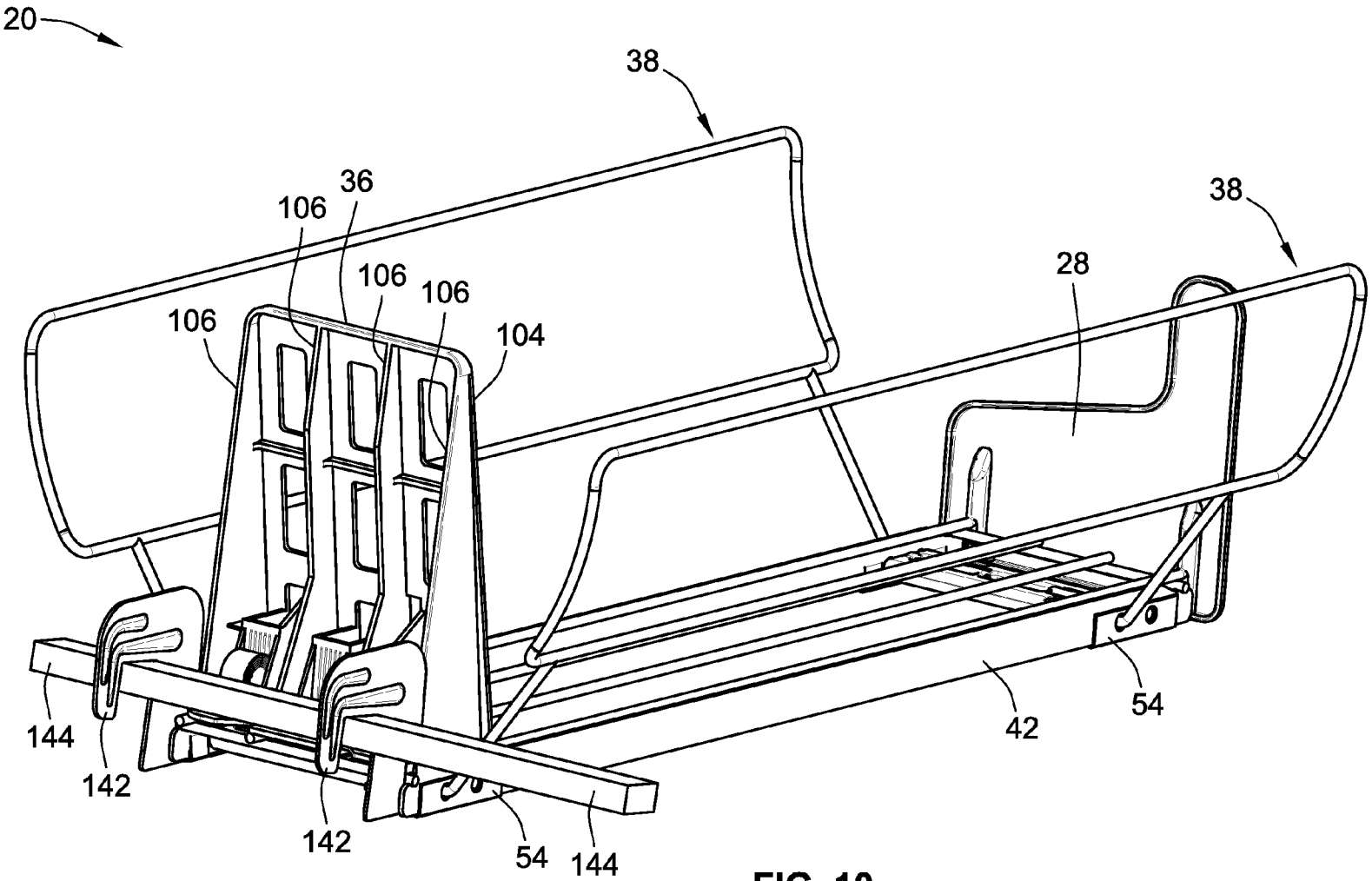
FIG. 10 is a perspective view of another embodiment of the pusher tray, shown mounted to a support bar.

Turning now to FIG. 10, and alternate embodiment of pusher tray 20 is illustrated. This embodiment differs from the above described embodiment only to the extent that it is configured to mount on a retail merchandise support bar 144 as shown, as opposed to a retail shelf. In this embodiment, each support member 42 includes hook portions 142 to facilitate such mounting. These hook portions 142 may be unitary with the remainder support member 42, or may be additional plate elements which are welded to support member 42. In such a welded up embodiment, the hook portions 142 may include an elongate portion which overlaps a portion of support member 42, such that the combined bending resistance of this region of overlap is greater than a bending resistance of the remainder of each support member 42 not so overlapped.

It will also be appreciated that such elongate portions will also include apertures which align with existing apertures 74, 76 to allow for passage of horizontal portions 64.

Although not illustrated, pusher 36 may also include a locking arm such as the locking arm described in U.S. patent application Ser. No. 13/288,058, filed on Nov. 3, 2011, titled, "Merchandise Pusher Tray With Adjustable Side Barriers", which is assigned to the instant assignee, and incorporated by reference herein in its entirety by reference thereto. Such a locking arm advantageously allows pusher 36 to be locked in a position proximal the rear of pusher tray 30 so that merchandise 24 may be readily loaded into pusher tray without having to keep a hand on pusher 36 to force it to the rear of tray 20.

As described herein, the embodiments of the instant invention advantageously overcomes existing problems in the art with pusher trays by readily accommodating items of retail merchandise having a circular outer periphery, e.g. frozen pizzas, while also preventing the heretofore unacceptable forward lean or tipping of such items of retail merchandise caused by conventional pusher trays.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pusher tray for storing merchandise, the pusher tray comprising:

a base structure defining a retail merchandise support surface;

a pusher slideably retained on the base structure and configured to bias retail merchandise toward a front stop of the pusher tray;

a pair of opposed dividers slideably mounted to the base structure to adjust the width of the pusher tray, enabling items of various sizes to be stored in the pusher tray;

wherein each of the pair of dividers includes an arcuate frame portion having a radius of curvature, the arcuate frame portion configured to approximate a circular outer periphery of an item of retail merchandise carried by the pusher tray;

wherein each one of the pair of dividers includes a pair of support elements, the arcuate frame portion supported by the pair of support elements such that the pair of support elements extend from the arcuate frame portion and such that terminal ends of the support elements are received in the base structure;

wherein each support element includes a straight portion and an angled portion arranged at an obtuse angle relative to the straight portion, wherein the angled portion is tangent to a radius of curvature defined by the arcuate frame portion.

2. The pusher tray of claim 1, wherein the base structure includes a pair of opposed support members and a wire frame supported by the support members.

3. The pusher tray of claim 2, wherein each support member includes at front and rear ends thereof a relief notch, wherein the wire support frame is mounted to the support members in the relief notches.

4. The pusher tray of claim 1, wherein the arcuate frame portion has a first length, and wherein the pair of support elements are spaced apart a second length, wherein the first length is greater than the second length.

5. The pusher tray of claim 1, wherein the radius of curvature is between 3 inches and 12 inches.

6. The pusher tray of claim 1, wherein the pusher has a front wall and a floor, the front wall extending upwardly from the floor at an acute angle such that the front wall is not perpendicular to the floor.

7. A pusher tray for storing merchandise, the pusher tray comprising:

a base structure defining a retail merchandise support surface;

a pusher slideably retained on the base structure and configured to bias retail merchandise toward a front stop of the pusher tray, the pusher having a floor and a front wall extending upwardly from the floor such that the front wall is oriented at an acute angle relative to the retail support surface;

a pair of opposed dividers slideably mounted to the base structures to adjust the width of the pusher tray, enabling items of various sizes to be stored in the pusher tray;

wherein each of the pair of dividers includes a frame portion and a pair of support elements supporting the frame portion; wherein each support element includes a straight portion and an angled portion arranged at an obtuse angle, relative to the straight portion; and wherein the frame portion of each divider is arcuate, the arcuate frame portion supported by the pair of support elements such that the pair of support elements are tangent to the arcuate frame portion, wherein terminal ends of the support elements are received in the base structure, wherein the arcuate frame portion is configured to approximate a circular outer periphery of an item of retail merchandise carried by the pusher tray.

8. The pusher tray of claim 7, wherein the base structure includes a pair of opposed support members and a wire frame supported by the support members.

9. The pusher tray of claim 8 wherein each support member includes at front and rear ends thereof a relief notch, wherein the wire support frame is mounted to the support members in the relief notches.

10. The pusher tray of claim 7, wherein the arcuate frame portion has a first length, and wherein the support elements are spaced apart a second length, wherein the first length is greater than the second length.

11. The pusher tray of claim 7, wherein the radius of curvature is between 3 inches and 12 inches.

12. The pusher tray of claim 7, wherein the pusher has a front wall and a floor, the front wall extending upwardly from the floor at an acute angle such that the front wall is not perpendicular to the floor.

13. A pusher tray for storing frozen pizzas having a circular outer periphery, the pusher tray, comprising:

a base structure defining a retail merchandise support surface;

a pusher slideably retained on the base structure and configured to bias retail merchandise toward a front stop of the pusher tray, the pusher having a floor and a front wall extending upwardly from the floor such that the front wall is oriented at an acute angle relative to the retail support surface;

a pair of opposed dividers slideably mounted to the base structure to adjust the width of the pusher tray, enabling items of various sizes to be stored in the pusher tray; and wherein each of the pair of dividers includes an arcuate frame portion and a pair of support elements supporting the arcuate frame portion such that an angled portion of each support element is tangent to a radius of curvature defined by each arcuate frame portion; and wherein each support element includes a straight portion arranged at an obtuse angle relative to the angled portion of the support element, wherein the arcuate frame portion is configured to approximate the circular outer periphery of the frozen pizzas carried by the pusher tray.

14. The pusher tray of claim 13, wherein the radius of curvature is between 3 inches and twelve inches.

15. The pusher tray of claim 13, wherein the base structure includes a pair of opposed support members and a wire frame supported by the support members.

16. The pusher tray of claim 15 wherein each support member includes at front and rear ends thereof a relief notch, wherein the wire support frame is mounted to the support members in the relief notches.

* * * * *